US009923317B2

(12) United States Patent
Yao et al.

(10) Patent No.: US 9,923,317 B2
(45) Date of Patent: Mar. 20, 2018

(54) ELECTRICAL CONNECTOR WITH COLLAR SHELL RETAINED THEREIN

(71) Applicant: FOXCONN INTERCONNECT TECHNOLOGY LIMITED, Grand Cayman (KY)

(72) Inventors: Tao Yao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/135,511

(22) Filed: Apr. 21, 2016

(65) Prior Publication Data

US 2016/0315423 A1 Oct. 27, 2016

(30) Foreign Application Priority Data

Apr. 21, 2015 (CN) ..... 2015 1 0189890

(51) Int. Cl.

| | |
|---|---|
| ***H01R 13/6585*** | (2011.01) |
| ***H01R 13/6581*** | (2011.01) |
| ***H01R 13/6594*** | (2011.01) |
| ***H01R 13/6597*** | (2011.01) |
| ***H01R 24/62*** | (2011.01) |
| *H01R 24/28* | (2011.01) |
| *H01R 12/72* | (2011.01) |

(Continued)

(52) U.S. Cl.

CPC ..... *H01R 24/62* (2013.01); *H01R 13/6594* (2013.01); *H01R 12/721* (2013.01); *H01R 13/521* (2013.01); *H01R 13/5202* (2013.01); *H01R 13/6593* (2013.01)

(58) Field of Classification Search

CPC ..... H01R 13/6585; H01R 13/6581; H01R 13/6594; H01R 13/6597; H01R 13/6582; H01R 24/28; H01R 13/6591; H01R 13/6593; H01R 13/6596; H01R 13/6658

See application file for complete search history.

(56) References Cited

U.S. PATENT DOCUMENTS 9,300,095 B2 * 3/2016 Lin ..... H01R 24/60
9,306,337 B2 * 4/2016 Yu ..... H01R 24/60

(Continued)

FOREIGN PATENT DOCUMENTS

CN 203871583 10/2014
CN 104348025 A 2/2015

(Continued)

OTHER PUBLICATIONS

English Translation of CN 204243365.*

*Primary Examiner* — Michael A Lyons
*Assistant Examiner* — Matthew T Dzierzynski
(74) *Attorney, Agent, or Firm* — Wei Te Chung; Ming Chieh Chang

(57) ABSTRACT

An electrical connector comprising an insulative body, a plurality of terminals secured in said insulative body, and a grounding shell. Wherein said grounding shell is composed of two U-shaped collar shells oppositely assembled onto said insulative body. The connector also includes an insulator injected upon said grounding shell and a metallic shell assembled upon said insulator. Each collar shell includes a spring arm extending beyond said insulator and abutting against said metallic shell.

20 Claims, 13 Drawing Sheets

(51) Int. Cl.
*H01R 13/52* (2006.01)
*H01R 13/6593* (2011.01)

(56) References Cited

U.S. PATENT DOCUMENTS

| | | | | |
|---|---|---|---|---|
| 9,466,924 | B2 * | 10/2016 | Lin | H01R 13/6585 |
| 2015/0244111 | A1 * | 8/2015 | Ju | H01R 13/6585<br>439/607.05 |

FOREIGN PATENT DOCUMENTS

| | | | | |
|---|---|---|---|---|
| CN | 204144593 | | 2/2015 | |
| CN | 204243365 | | 4/2015 | |
| CN | 204243365 U | * | 4/2015 | H01R 13/652 |
| CN | 204361414 U | | 5/2015 | |

* cited by examiner

ELECTRICAL CONNECTOR WITH COLLAR SHELL RETAINED THEREIN

BACKGROUND OF THE INVENTION

1. Field of the Invention

The present invention relates to an electrical connector, and particularly to the electrical connector having a grounding shell composed with two U-shaped collar shells.

2. Description of Related Art

The Chinese Utility Patent No. CN104348025A discloses an electrical connector combination comprising a plug connector. The plug connector comprises an exposed abutting tongue plate provided with a top surface and a bottom surface and terminals disposed on the top surface and the bottom of the tongue plate. The termininals on each surface at least comprise power terminals, differential pairs of terminals, and grounding terminals. Each of both lateral side surfaces of the tongue plate is provided with a gap. The power terminals are arranged in the gaps. The electrical connector combination may transmit power or be grounded through a metallic reinforcer and simultaneously provides a buckling effect when two connectors are abutted. Notably, the metallic reinforcer is designed as an integrally molded piece, which is bad for a smooth and easy assembling process.

Hence, an electrical connector including an improved structure is necessary.

SUMMARY OF THE INVENTION

Accordingly, an object of the present invention is to provide an electrical connector overcoming the aforementioned shortcoming.

To achieve the above object, an electrical connector is provided, comprising an insulative body, a plurality of terminals secured in said insulative body, and a grounding shell. Wherein said grounding shell is composed of two U-shaped collar shells oppositely assembled onto said insulative body. The connector also includes an insulator injected upon said grounding shell and a metallic shell assembled upon said insulator. Each collar shell includes a spring arm extending beyond said insulator and abutting against said metallic shell.

Other objects, advantages and novel features of the invention will become more apparent from the following detailed description when taken in conjunction with the accompanying drawings.

DETAILED DESCRIPTION OF THE PREFERRED EMBODIMENT

Figure 1:
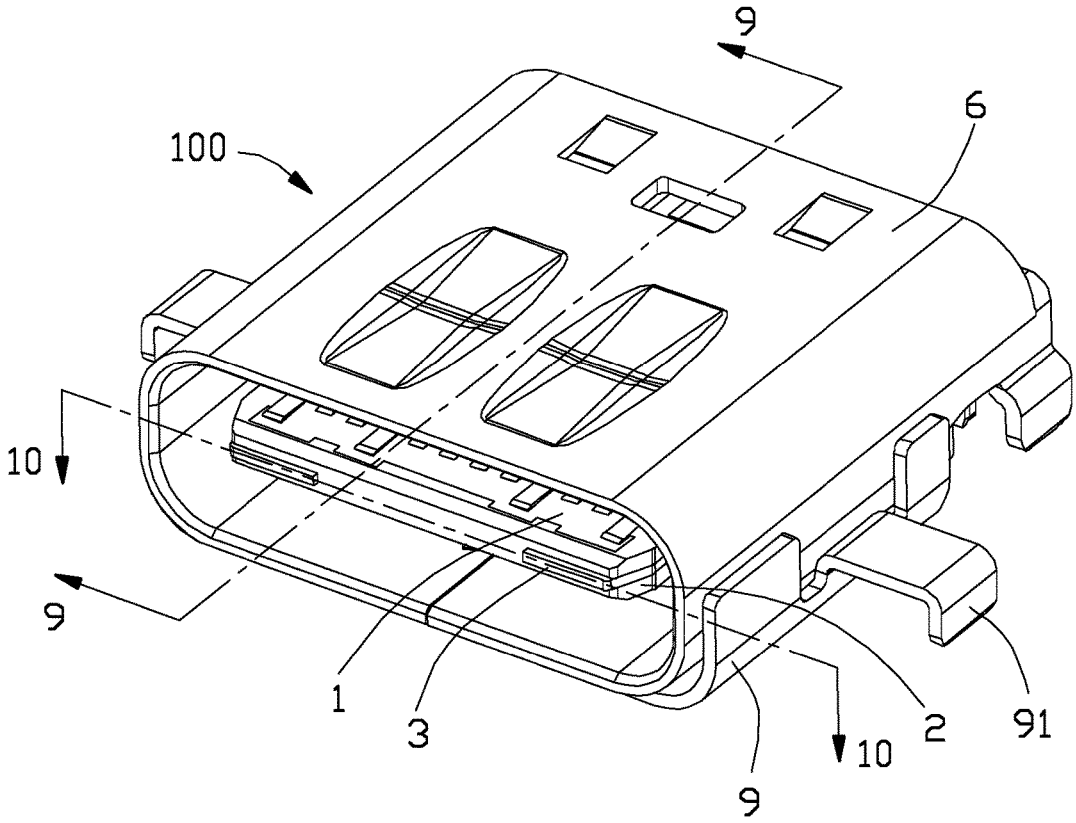
FIG. 1 is a perspective view of the electrical connector, according to a first embodiment of the invention.
Figure 2:
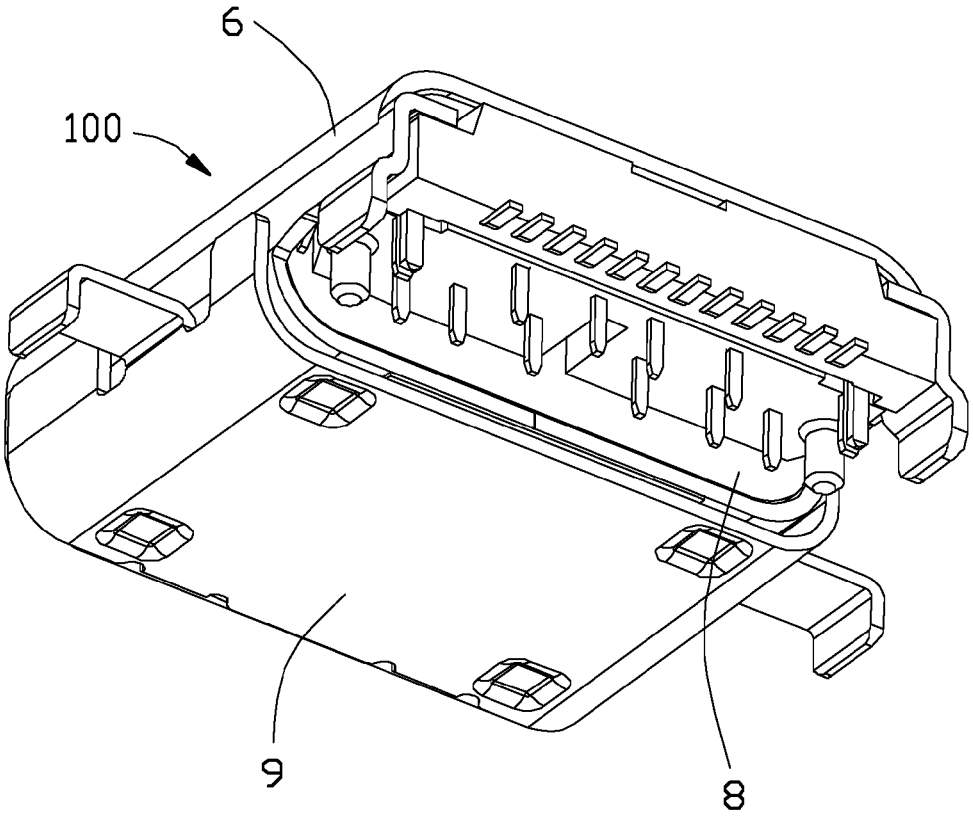
FIG. 2 is another perspective view of the electrical connector in FIG. 1.

Reference will now be made in detail to the preferred embodiment of the present invention.

Referring to FIGS. 1-10, an electrical connector 100, according to a first embodiment, comprises an upper terminal module 1, a lower terminal module 2, a shielding plate 3 sandwiched therebetween, and a grounding shell. A complementary connector (not shown) is mated to the connector 100 rearwardly along a front-to-rear direction. The grounding shell is composed of a pair of horizontally U-shaped collar shells 4 oppositely mating to the upper terminal module 1 and the lower terminal module 2 along a left-to-right direction perpendicular to the front-to-rear direction, wherein both directions are in a horizontal plane, and covering the surfaces of the upper terminal module 1 and the lower terminal module 2. Further, the connector 100 includes an insulator 5 injection molded around the upper terminal module 1 and the lower terminal module 2 and the shielding plate 3 located therebetween, the collar shells 4, a metallic shell 6 assembled upon the insulator 5, a waterproofing membrane 7 attached upon one side of the metallic shell 6, a waterproofing plate 8 molded in the back of the insulator 5 via a fluid-dispensing process, and a sub shell 9 retained upon one side of the metallic shell 6 which side the waterproofing membrane 7 is disposed upon, via a dot welding process.

Figure 8:
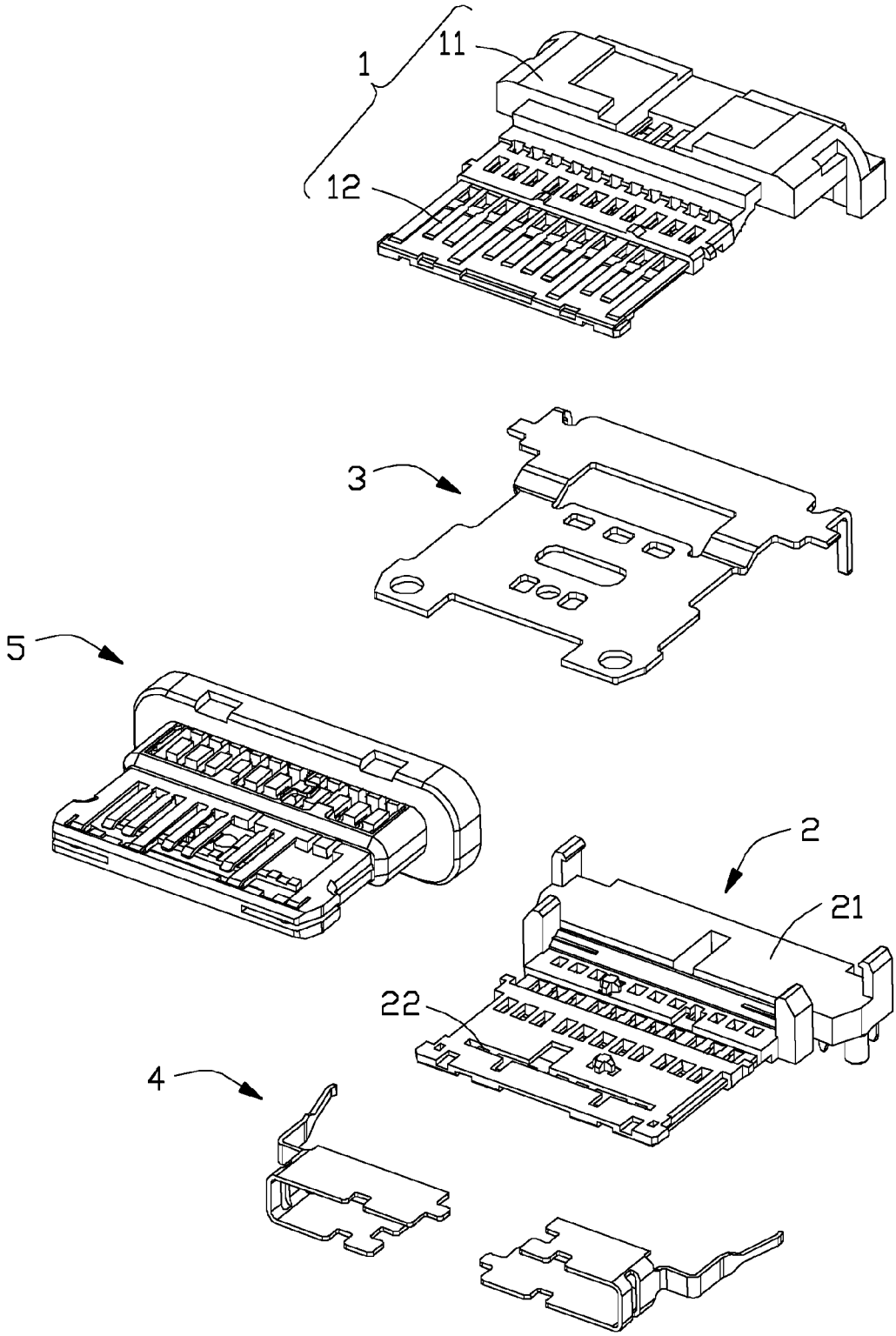
FIG. 8 is a further exploded perspective view of the terminal module in FIG. 7.

Referring to FIG. 8, the aforementioned upper terminal module 1 includes an upper insulative body 11 and a plurality of upper terminals 12 retained therein. The aforementioned lower terminal module 2 includes a lower insulative body 21 and a plurality of lower terminals 22 retained therein. Each of the upper insulative body 11 and the lower insulative body 21 includes a base section 13 and a tongue section 14 extending forwardly therefrom. Each base section 13 defines a groove 16 in which the upper terminals 12 or the lower terminals 22 are exposed. Noted, two grooves 16 of the insulative body 11 and the lower insulative body 21 correspond to each other in a vertical direction perpendicular both the front-to-rear direction and the left-to-right direction. Preferred, the upper insulative body 11 defines a dispensing gate 161 connecting to the grooves 16. Each of the upper insulative body 11 and the lower insulative body 21 includes two positioning embosses 131 respectively located at two opposite side edges thereof in the left-to-right direction, for positioning the collar shells 4 in the front-to-rear direction when the collar shells 4 assembling. And at least a leading emboss 132 is disposed upon both a top surface of the upper insulative body 11 and a bottom surface of the lower insulative body 21, so as to prevent the collar shells 4 turning back in the left-to-right direction after the collar shells 4 assembled. The tongue section 14 includes a step 133 for abutting against the rear edges of collar shells 4 forwardly.

Figure 9:
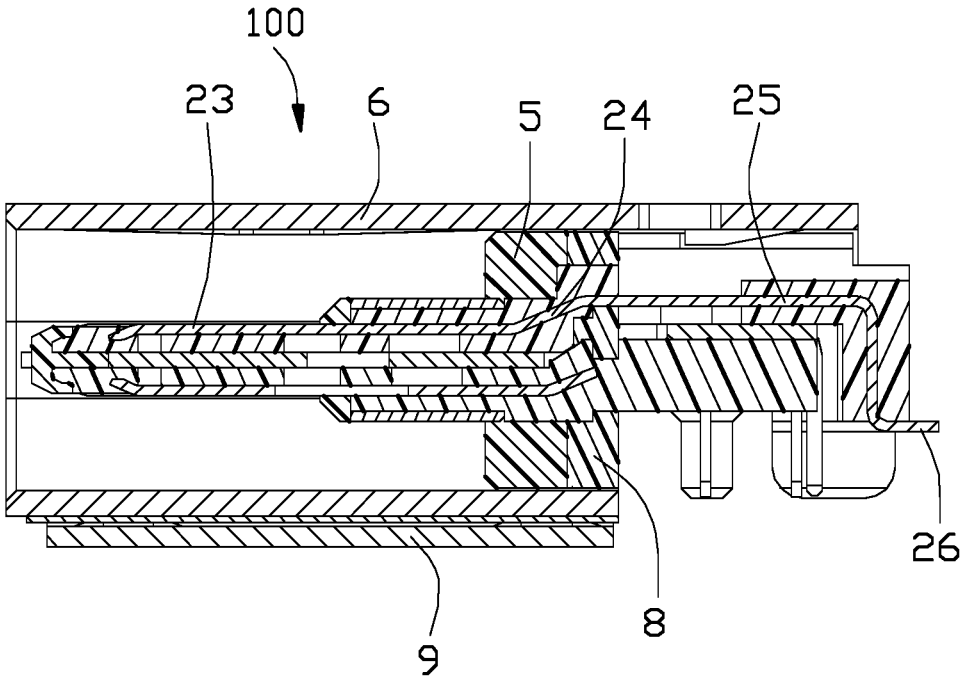
FIG. 9 is a cross-sectional view of the electrical connector along line 9-9 in FIG. 1.

Referring to FIGS. 8 and 9, each of the aforementioned upper terminals 12 and lower terminals 22 includes a contacting section 23 extending forwardly and exposed upon the tongue section 14, a connecting section 24 exposed within the groove 16, a retaining section 25 retained in the based section 13 and a soldering section 26 extending beyond the base section 13, in an orderly continuous manner. The upper terminals 12 and lower terminals 22 extend along the front-to-rear direction, while the groove 16 extends along the left-to-right direction. The waterproofing plate 8 is formed by fluid glue (not shown) flowing into the groove 16 via the dispensing gate 161. Notably, the base section 13 in back of the groove 16 is disposed out of the waterproofing plate 8, which helps confine the upper terminals 12 and the lower terminals 22, so as to ensure a reliable soldering process.

Figure 10:
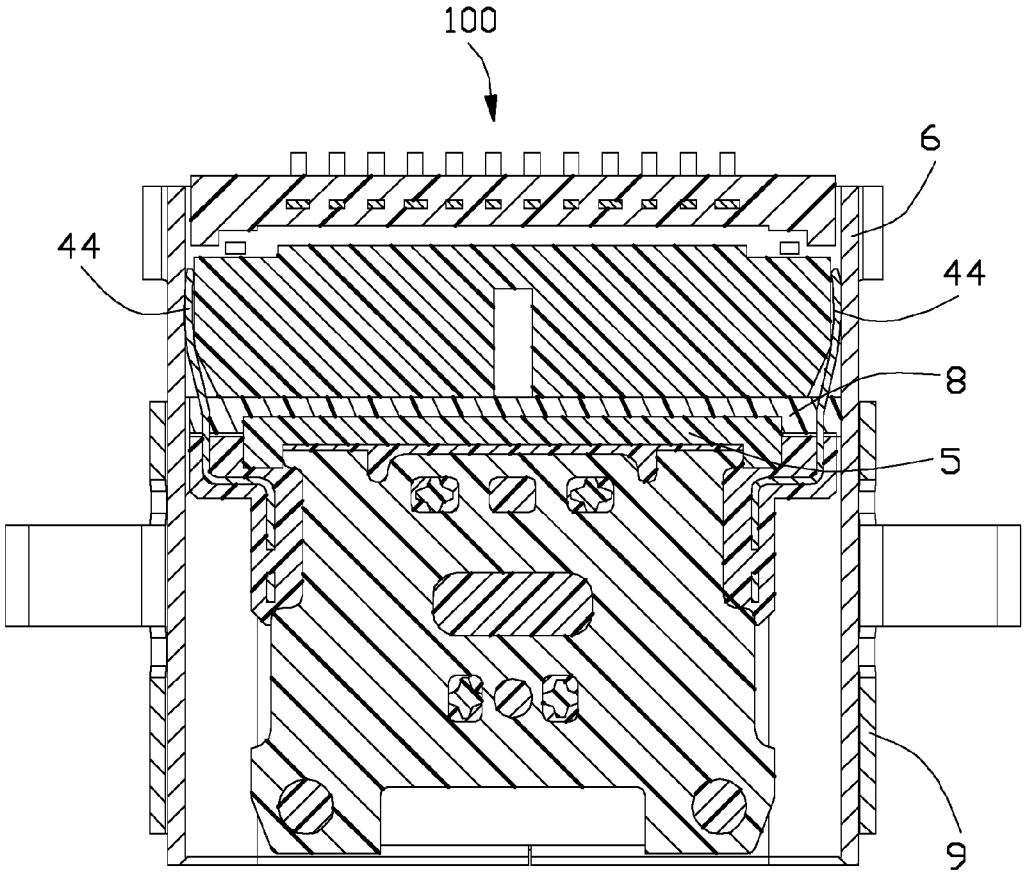
FIG. 10 is a cross-sectional view of the electrical connector along line 10-10 in FIG. 1.

Referring to FIGS. 8 and 10, the collar shells 4 have a pair of U-shaped structure corresponding to each other along the left-to-right direction. Each collar shell 4 includes a vertical body 41, an upper arm 42 and a lower arm 43 parallel to each other, face-to-face extending respectively from two opposite side edges of the body 41 in the vertical direction, and a spring arm 44 extending backwardly from a rear side edge of the body 41. The two upper arms 42 of the two collar shells 4 are compliant to each other by a concave-convex structure, wherein one of the two upper arms 42 includes a first dovetail groove 421 while the other one includes a first protrusion 422 mating to the first dovetail groove 421. Understandably, such compliance may not perform any meaningful engagement therebetween for any strict retention but a rough restriction because the retention of the collar shell 4 is performed with the base section 13. Similarly, one of the two lower arms 43 includes a second dovetail groove 431 while the other one includes a second protrusion 432 complying with the second dovetail groove 431. Preferably, a first mating position where the first dovetail groove 421 and the first protrusion 422 mate to each other is not in alignment with a second mating position where the second protrusion 432 and the second dovetail groove 431 mate to each other in the vertical direction, which prevents a spring section of a shell of the complementary connector (not shown) from contacting the collar shells 4 at the first mating position or the second mating position.

Figure 11:
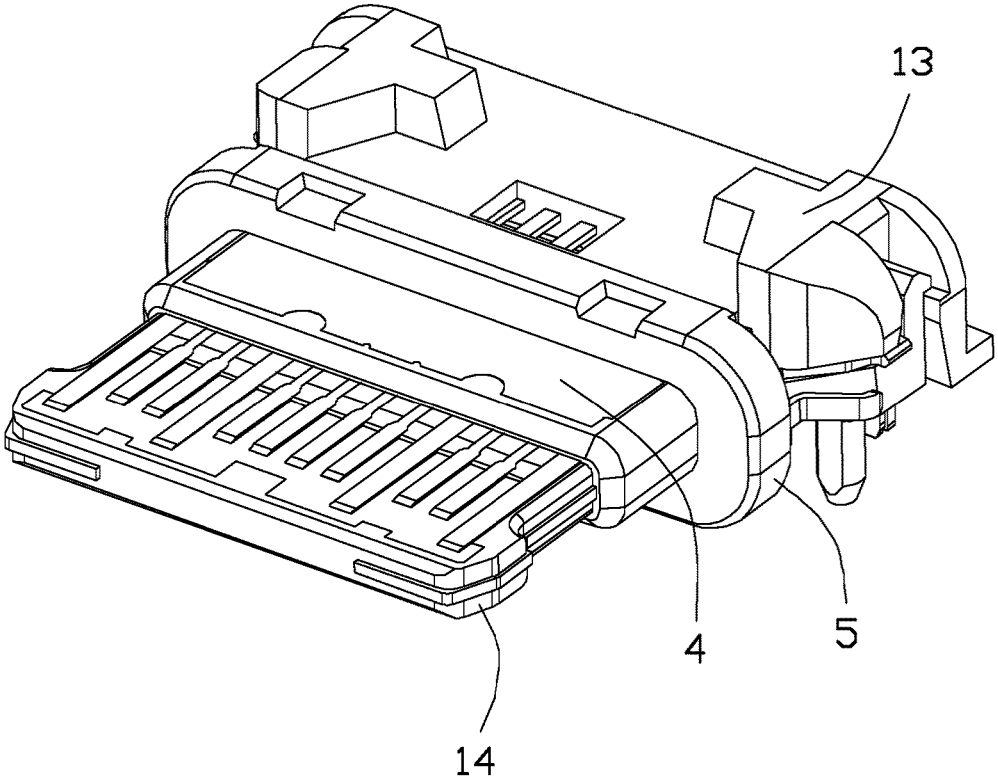
FIG. 11 is a perspective view of another complete terminal module, according to a second embodiment of the invention.
Figure 12:
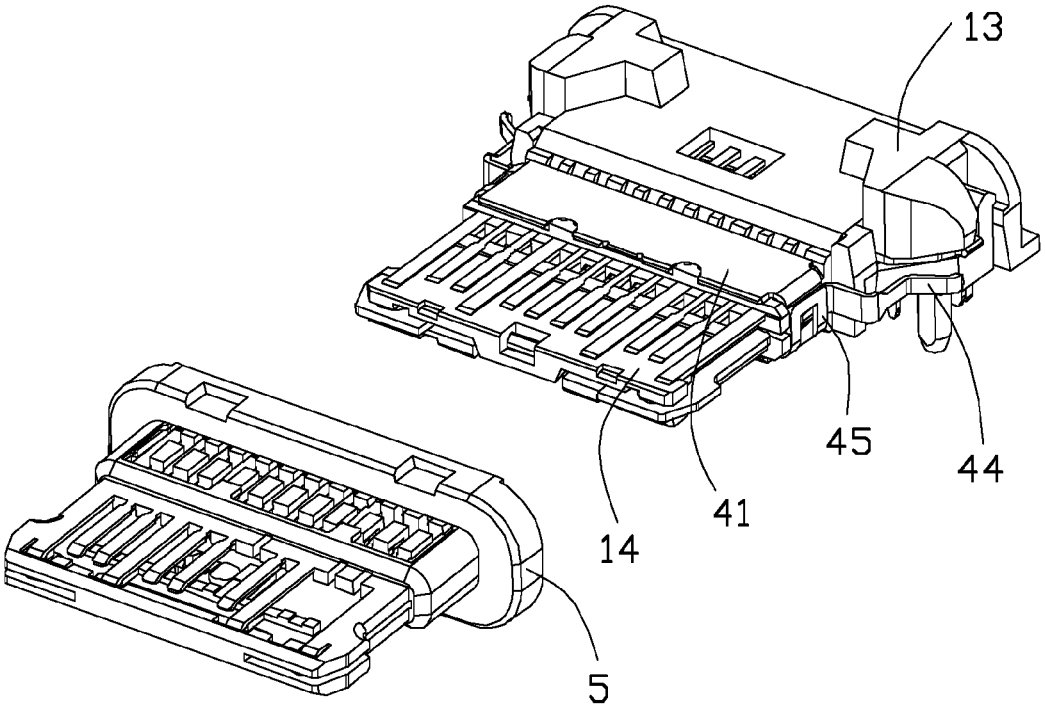
FIG. 12 is an exploded perspective view of the terminal module in FIG. 11.
Figure 13:
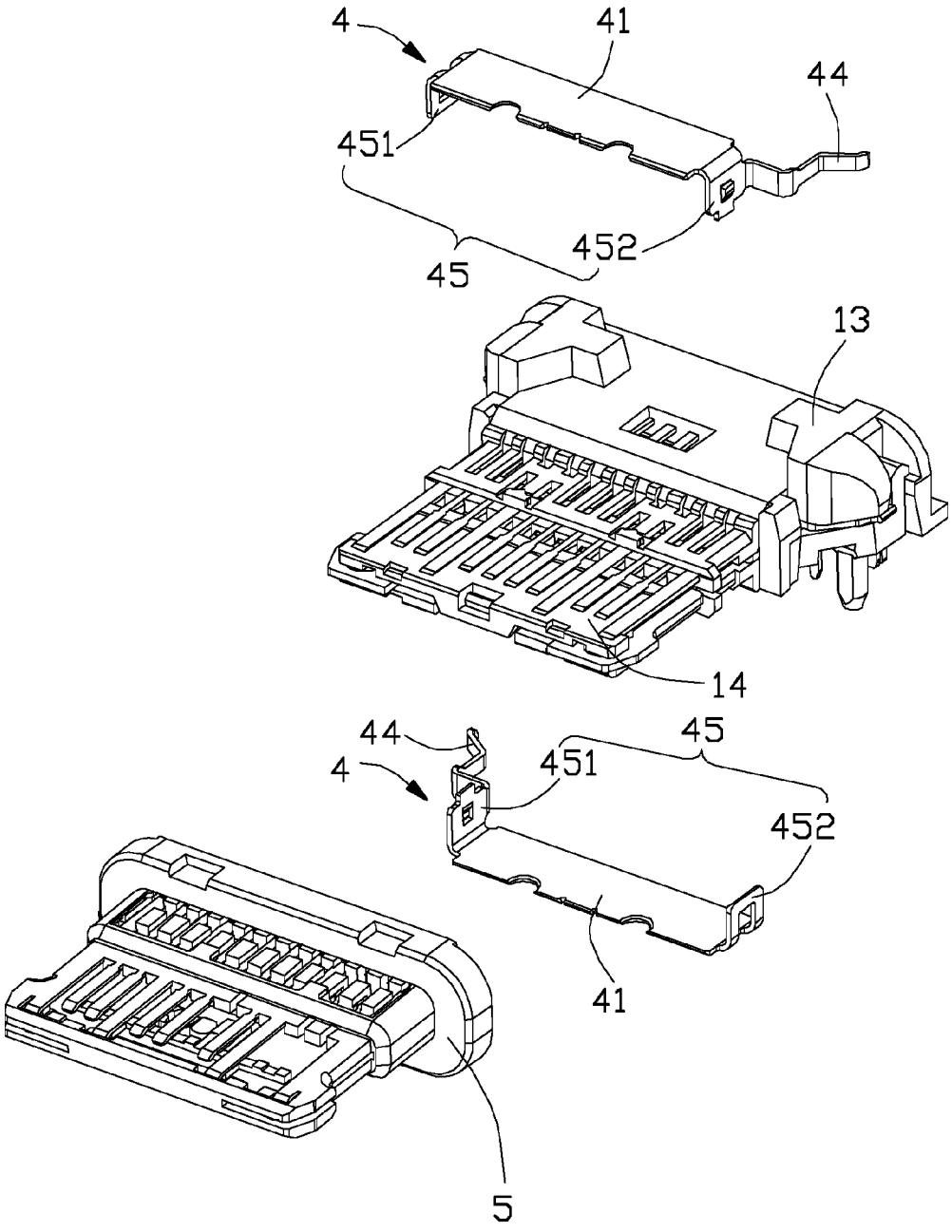
FIG. 13 is a further exploded perspective view of the terminal module in FIG. 12.

FIGS. 11, 12 and 13 disclose a second embodiment including a complete terminal module, wherein the complete terminal module includes a pair of U-Shaped collar shells 4 mating to each other along the vertical direction different from the left-to-right direction in the first embodiment. Each collar shell 4 includes a horizontal body 41, a pair of side arms 45 extending vertically respectively from two opposite side edges of the body 41 in left-to-right direction, and a spring arm 44 extending rearwardly from a rear side edge of one of the two side arms 45. In this embodiment, the spring arm 44 of the upper collar shell 4 is disposed at the right side arm 452 while the spring arm 44 of the lower collar shell 4 is disposed at the left side arm 451. And the two collar shells 4 mate to each other at the side arms 45 by a concave-convex structure.

Figure 5:
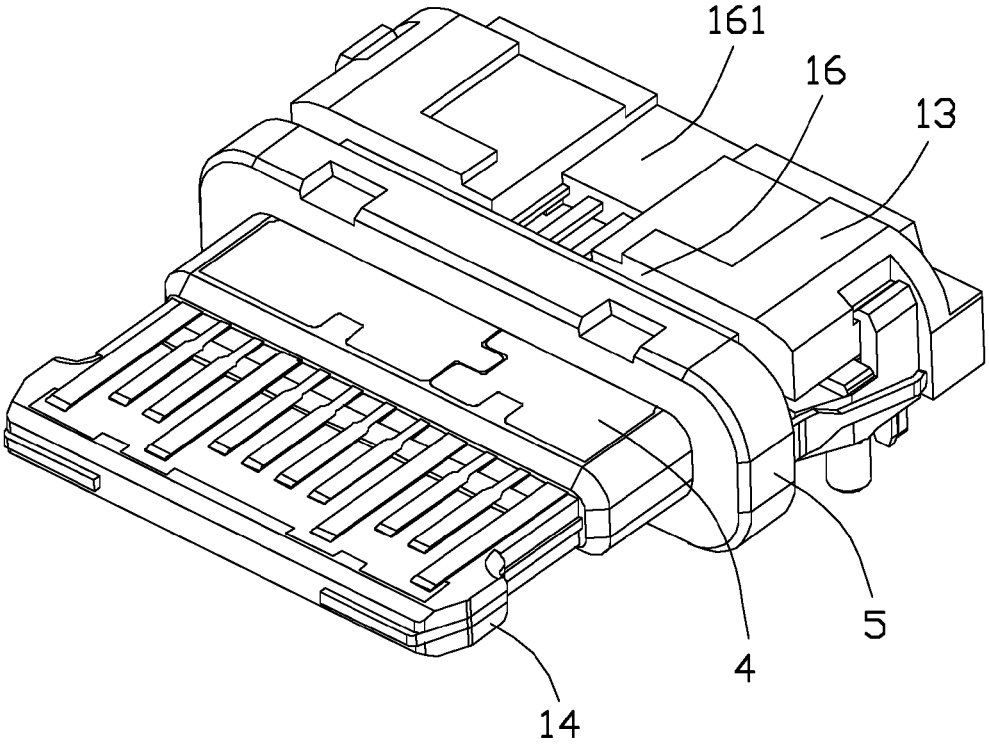
FIG. 5 is a perspective view of the terminal module without the waterproofing plate in FIG. 3.
Figure 6:
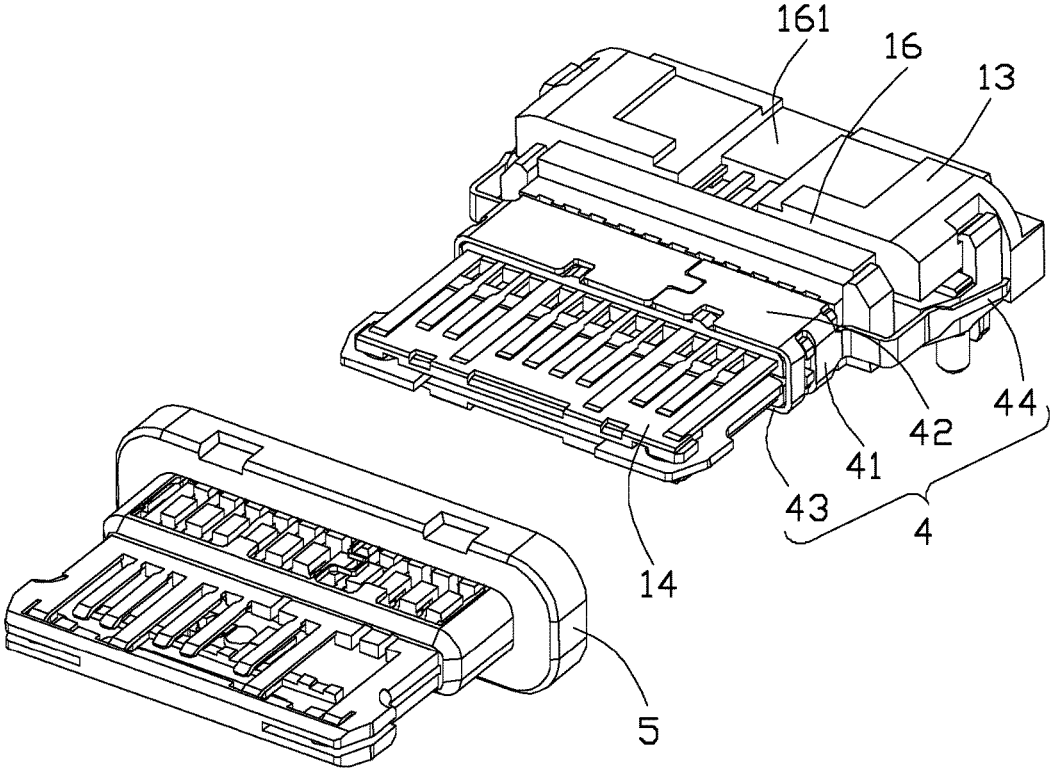
FIG. 6 is an exploded perspective view of the terminal module in FIG. 5.
Figure 7:
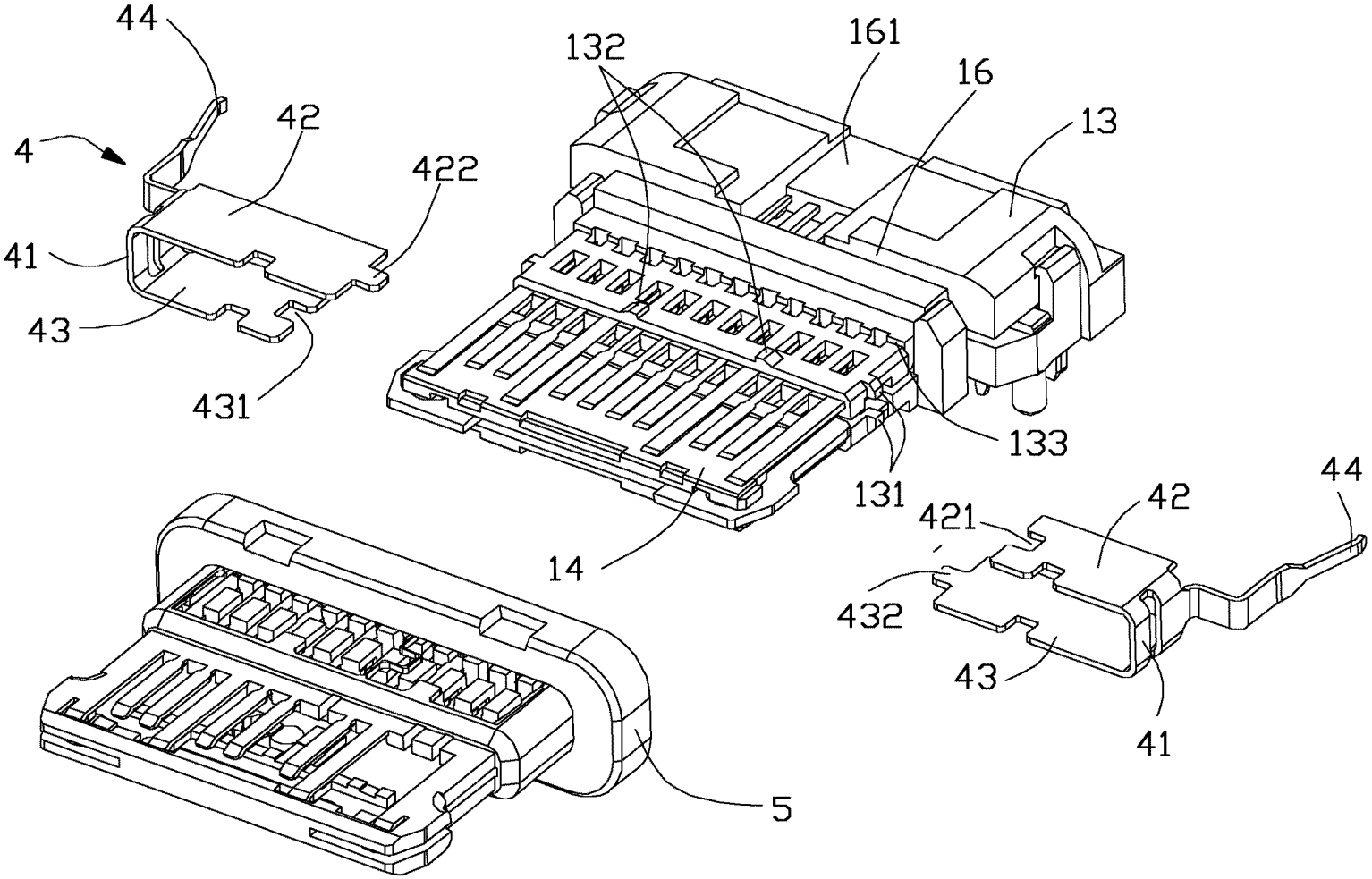
FIG. 7 is a further exploded perspective view of the terminal module in FIG. 6.

Referring to FIGS. 5 and 10, the insulator 5 is injection molded upon the collar shells 4 for fixation therebetween and the spring arms 44 of the collar shells 4 are exposed beyond the insulator 5 and contact electrically the metallic shell 6 for a shorter grounding circuit so as to remove effectively static electricity. In the preferred embodiment, the insulator 5 is injection molded over the collar shells 4 via an over-molding process.

Figure 3:
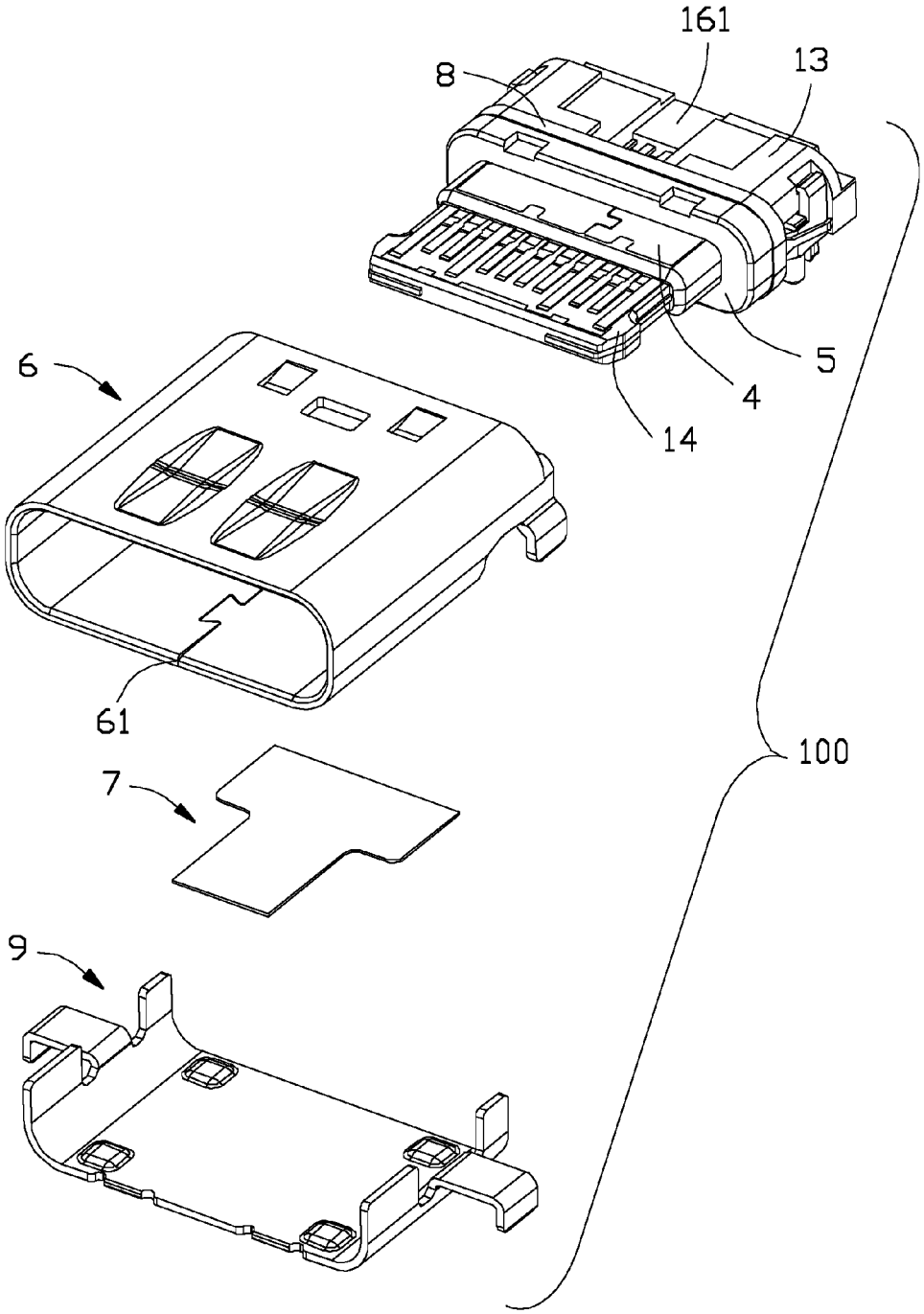
FIG. 3 is an exploded perspective view of the electrical connector in FIG. 1, wherein a metallic shell, a sub shell and a waterproofing membrane are removed away from a complete terminal module combined with an upper terminal module, a lower terminal module, a shielding plate, a waterproofing plate, an insulator formed in a second step insert-molding process, wherein the upper terminal module and the lower terminal module are formed via a first step insert-molding process, and a pair of collar shells.
Figure 4:
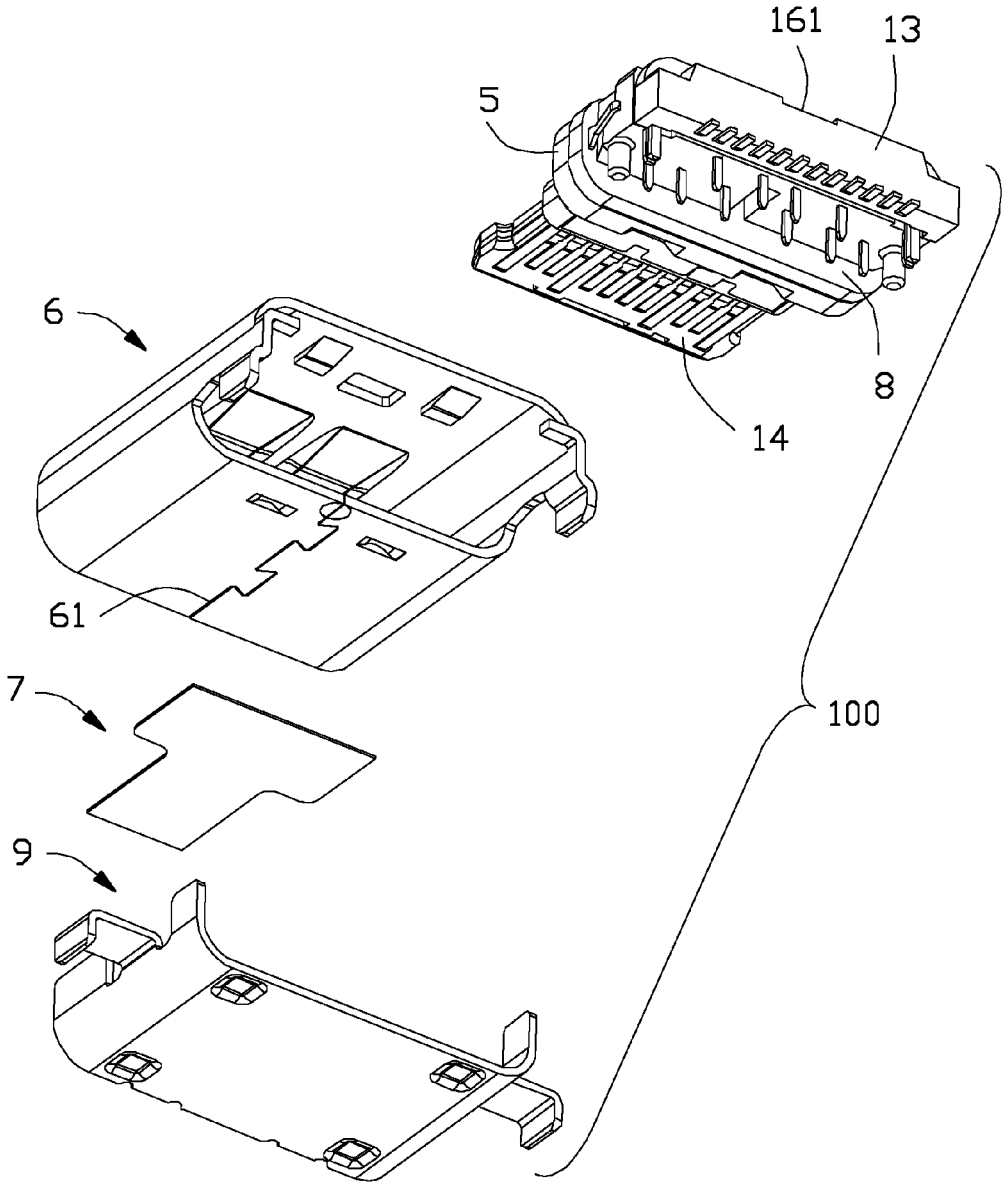
FIG. 4 is another exploded perspective view of the electrical connector in FIG. 3.

Referring to FIGS. 3 and 4, the metallic shell 6 is formed by a stamping process and includes an engaging slot 6 located at a bottom thereof. The waterproofing membrane 7 attaches upon a bottom of the metallic shell 6 to seal the engaging slot 61 for a waterproofing function. The fluid glue flows into the groove 16 via the dispensing gate 161 for forming the waterproofing plate 8, which further helps the waterproofing function works better.

Referring to FIGS. 1 to 4, the sub shell 9 is retained upon one side of the metallic shell 6 via a dot welding process and includes a pair of pegs 91 to fix the connector 100 to a PCB (printed circuit board) (not shown).

Preferably, the connector 100 is a receptacle connector applied to both general and inverse insertion of complementary connector (not shown). Thus the connector 100 includes the upper terminal module 1 including the upper insulative body 11 and the upper terminals 12, and the lower terminal module 2 including the lower insulative body 21 and the lower terminals 22, wherein the contacting sections 23 of the upper terminals 12 and the lower terminals 22 are symmetrically arranged for an inverse insertion of the complementary connector (not shown). Notably, in the other embodiment, the connector 100 can be equipped with an integrally molded insulative body instead and a plurality of terminals retained therein.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising an insulative body;

a plurality of terminals each extending in a front-to-rear direction and arranged with one another in a left-to-right direction perpendicular to the front-to-rear direction and secured in said insulative body; and a grounding shell;

wherein said grounding shell includes two U-shaped collar shells oppositely assembled onto said insulative body; the connector also includes an insulator injection molded upon said grounding shell and a metallic shell assembled upon said insulator; each collar shell includes a spring arm extending beyond said insulator and abutting against said metallic shell;

wherein said insulative body defines a groove therein for sealing, in which portions of the terminals are exposed; the two spring arms are located respectively at a leftmost side and a rightmost side of the terminals in the left-to-right direction and extend through the groove backwardly.

2. The connector as claimed in claim 1, wherein said two collar shells are assembled to said insulative body along said left-to-right direction; each collar shell includes a body, an upper arm and a lower arm face-to-face extending respectively from two opposite side edges of said body in a vertical direction perpendicular to said left-to-right direction and said front-to-rear direction, the spring arm extending backwardly from a rear side edge of said body.

3. The connector as claimed in claim 2, wherein one of two upper arms of said two collar shells includes a first dovetail groove while the other one includes a first protrusion mating to said first dovetail groove; similarly, one of two lower arms of said two collar shells includes a second dovetail groove while the other one includes a second protrusion mating to said second dovetail groove.

4. The connector as claimed in claim 3, wherein the upper arm of each collar shell includes said first dovetail groove while the lower arm of said collar shell includes said second protrusion.

5. The connector as claimed in claim 3, wherein a first mating position where said first dovetail groove and said first protrusion mate to each other is staggered with a second mating position where said second protrusion and said second dovetail groove mate to each other in a vertical direction perpendicular to both said left-to-right direction and said front-to-rear direction.

6. The connector as claimed in claim 2, wherein said insulative body is combined with an upper insulative and a lower insulative body; each insulative body includes two positioning embosses respectively located at two opposite side edges thereof in said left-to-right direction, for positioning said collar shells in said front-to-rear direction when assembling said collar shells.

7. The connector as claimed in claim 6, wherein each insulative body includes at least a leading emboss disposed upon both a top surface of the upper insulative body and a bottom surface of the lower insulative body, so as to prevent said collar shells turning back in said left-to-right direction after said collar shells are assembled.

8. The connector as claimed in claim 1, wherein said two collar shells mate to each other along a vertical direction; each collar shell includes a horizontally extending body defining two opposite side edges in a left-to-right direction perpendicular to said vertical direction, a pair of side arms extending vertically respectively from said two opposite side edges of the body, and a spring arm extending rearwardly from a rear side edge of one of said side arms in a front-to-rear direction perpendicular to both said vertical direction and said left-to-right direction.

9. The connector as claimed in claim 6, wherein said spring arm of the upper collar shell is disposed at the right side arm while said spring arm of the lower collar shell is disposed at the left side arm.

10. An electrical connector comprising:

a terminal assembly enclosed within a metallic shell and including a subassembly essentially composed of an upper terminal module and a lower terminal module commonly sandwiching a metallic shielding plate therebetween in a vertical direction, said upper terminal module including a plurality of upper terminals retained within an upper insulative body and said lower terminal module including a plurality of lower terminals retained within a lower insulative body;

the whole terminal assembly forming a base section with a tongue section forwardly extending therefrom in a front-to-back direction perpendicular to said vertical direction;

a grounding shell surrounding around a root region of the tongue section and including a pair of collar shells configured to be respectively attached around said root region of the tongue section in opposite transverse directions which are perpendicular to both said vertical direction and said front-to-back direction; wherein each of said collar shells defines a U-shaped cross-sectional configuration around the root region in a front view along the front-to-back direction, and the U-shaped cross-sectional configurations of said pair of collar shells confront each other in the transverse direction.

11. The electrical connector as claimed in claim 10, wherein said root region forms means for assembling the corresponding collar shell thereto along the transverse direction without risks of disassembling therefrom in an opposite transverse direction, and means for restricting movement of the collar shell relative to the root region in the front-to-back direction.

12. The electrical connector as claimed in claim 10, further including an insulator applied to the terminal assembly so as to form a final configuration of a combination of said terminal assembly and the insulator, wherein a portion of the grounding shell is covered by the insulator.

13. The electrical connector as claimed in claim 12, wherein the grounding shell includes a spring arm abutting against the metallic shell.

14. The electrical connector as claimed in claim 13, wherein said spring arm extends rearwardly from, in said transverse direction, one transverse end of the root region of the tongue section.

15. The electrical connector as claimed in claim 12, wherein the combination forms a groove around a rear portion thereof to receive a waterproofing plate therein, and a dispensing gate rearwardly communicates said groove with an exterior for injecting fluid glue into the groove to form said waterproofing plate.

16. The electrical connector as claimed in claim 10, wherein said pair of collar shells are coupled with each other around an interface therebetween, and the interface at an upper face of the tongue section is essentially offset from the interface at the bottom face of the tongue section in the transverse direction.

17. The electrical connector as claimed in claim 10, wherein the U-shaped configuration includes a pair of horizontal sections linked by a vertical section, and said pair of horizontal sections are seated upon opposite upper and bottom surfaces of the root region.

18. An electrical connector comprising:

a terminal assembly enclosed within a metallic shell and including a subassembly essentially composed of an upper terminal module and a lower terminal module commonly sandwiching a metallic shielding plate therebetween in a vertical direction, said upper terminal module including a plurality of upper terminals retained within an upper insulative body and said lower terminal module including a plurality of lower terminals retained within a lower insulative body;

the whole terminal assembly forming a base section with a tongue section forwardly extending therefrom in a front-to-back direction perpendicular to said vertical direction;

a grounding shell surrounding around a root region of the tongue section and including a pair of collar shells configured to be respectively attached around said root region of the tongue section in opposite vertical directions:

wherein said collar shells include a pair of spring arms respectively located at a leftmost side and a rightmost side of the terminal assembly in a transverse direction perpendicular to both said front-to-back direction and said vertical direction to abut against the metallic shell.

19. The electrical connector as claimed in claim 18, wherein said pair of collar shells are coupled with each other.

20. The electrical connector as claimed in claim 18, wherein one of said pair of spring arms unitarily rearwardly extends from one of said pair of collar shells, and the other of said pair of spring arms unitarily rearwardly extends from the other of said pair of collar shells.

* * * * *